United States Patent [19]

Haag

[11] 3,999,820

[45] Dec. 28, 1976

[54] REFRIGERATION APPARATUS ENCLOSURE STRUCTURE

[75] Inventor: Charles W. Haag, Evansville, Ind.

[73] Assignee: Whirlpool Corporation, Benton Harbor, Mich.

[22] Filed: Sept. 15, 1975

[21] Appl. No.: 613,462

Related U.S. Application Data

[63] Continuation-in-part of Ser. No. 433,072, Jan. 14, 1974, Pat. No. 3,933,398.

[52] U.S. Cl. ..... 312/214; 52/617; 62/DIG. 13; 312/236; 220/9 G

[51] Int. Cl.[2] ..... B65D 25/14; F16B 37/04; F25D 11/00

[58] Field of Search ..... 220/9 F, 9 G, 15, 18; 312/214, 236, DIG. 6; 52/36, 262, 617, 632; 151/41.75, 41.73; 62/DIG. 13

[56] References Cited

UNITED STATES PATENTS

| | | | |
|---|---|---|---|
| 1,484,273 | 2/1924 | Peele | 52/617 |
| 2,284,301 | 5/1942 | Reiser | 52/DIG. 6 |
| 3,501,215 | 3/1970 | Gartner | 312/236 |
| 3,662,805 | 5/1972 | Sygnator | 52/617 |
| 3,910,658 | 10/1975 | Lindenschmidt | 220/9 G |
| 3,933,398 | 1/1976 | Haag | 312/214 |

*Primary Examiner*—Casmir A. Nunberg
*Attorney, Agent, or Firm*—Wegner, Stellman, McCord, Wiles & Wood

[57] ABSTRACT

A refrigeration apparatus enclosure structure wherein an inner laminate wall portion of the enclosure defines the inner sheet liner and insulation disposed within an outer cabinet portion of the enclosure and is secured to a portion of the cabinet wall with the sheet liner portion maintained spaced from the cabinet wall to provide thermal insulation therebetween. The laminate wall is secured to the cabinet by insulative support means extending through openings in the insulation to the sheet liner and means are provided for securing the sheet liner to the inner end of the insulative supports. The insulating supports may further support other elements within the enclosure inwardly of the sheet liner. In one form, the insulating support may be held in position in the laminate wall insulation by an outer plate having inturned tabs extending into the insulation and insulating support. The plate may be held in place by a securing element so as to be in facial abutment with the rear surface of the laminate wall insulation and provide a distribution of forces from the support over a substantial area of the insulation outer surface.

11 Claims, 11 Drawing Figures

CUT
FOLD
FOLD
CUT 23
21
44
44
36
40
38
12
49
48
50
25
40
24
37
11
42
35
40
44
44
27
6.

80

43
42
26
45
38
80
57
29
46
29
63
59
61
58
62
60
39

45

44
30
41
36
6.
30
12
13
29
45
49
48
51
52
50
37
54
56
52
35
51
29
11
45
30

58b
61
57
40
60
39
70
26
29
37
30
45

REFRIGERATION APPARATUS ENCLOSURE STRUCTURE

CROSS-REFERENCE TO RELATED APPLICATIONS

This application comprises a continuation-in-part of my copending application Ser. No. 433,072, filed Jan. 14, 1974, and entitled "Refrigeration Apparatus Enclosure Structure" now U.S. Pat. No. 3,933,398.

BACKGROUND OF THE INVENTION

1. Field of the Invention

This invention relates to refrigeration apparatus enclosure structures, and in particular to means for mounting the sheet liner and insulation means of the enclosure to the outer cabinet.

2. Description of the Prior Art

In conventional refrigeration appliance cabinet constructions, an outer metal cabinet is provided having an inner liner which may conventionally be formed of plastic spaced inwardly therefrom to define a space in which is provided suitable insulation. The insulation may be in the form of fiberglass pads and in one improved form, the insulation comprises foamed-in-place insulation. One such foamed-in-place refrigeration apparatus enclosure construction is shown in U.S. Letters Pat. No. 2,962,183 of J. C. Rill, Jr. et al. Such foamed-in-place cabinet constructions are relatively costly as they utilize separate liner elements, relatively costly preparations for the foaming operation, and costly fixtures for accurately retaining the cabinet and liner elements during the foaming operation. The liners are relatively expensive in that they require relatively costly tooling and processing steps, and the cost problems of such conventional foamed-in-place construction are aggravated where a number of different size models must be provided.

One attempted solution to this problem is that shown in U.S. Letters Pat. No. 3,635,536 of Robert Lackey et al, wherein a portable refrigerator is shown as having a low cost cabinet utilizing a foam slab box having integral sides formed of a single sheet of foamed plastic. This patent teaches that if the foamed plastic is formed in a chilled mold process, coating of the inner and outer sides of the sheet may be omitted as the plastic is thusly formed with a thick impervious skin. A similar technique is shown in U.S. Letters Pat. No. 3,014,611 of F. R. Marshall. The box sides are formed from a vee-notched laminate slab which permits folding the laminate to the box configuration. Thus, the laminate forms the outer cabinet, liner and insulation. The notched corners are formed with fixtures to cement the panels together after the insertion of a sealing gasket.

SUMMARY OF THE INVENTION

The present development comprehends an improved refrigeration apparatus enclosure structure wherein a laminate wall defining the inner sheet liner and insulation of the enclosure is secured to the rear wall of the outer cabinet by insulative support means extending through openings in the insulation to the liner portion of the laminate wall. Securing means are mounted to the insulative supports for securing the sheet liner in spaced relationship to the cabinet wall with the insulation portion of the laminate wall abutting the inner surface of the cabinet wall. The insulative supports and openings in the laminate wall are preselected to maintain an alignment of the laminate wall with the cabinet wall whereby the periphery of the sheet liner portion is maintained spaced from the other cabinet walls to dispose the laminate wall in thermally insulated relationship. Further insulation means may be provided around the periphery of the laminate wall within the cabinet to fill the peripheral void therebetween.

The laminate wall support means is further adapted to provide support within the enclosure for supporting shelves and the like within the enclosure inwardly of the sheet liner. The supported shelves and the like synergistically cooperate with the securing means to retain the laminate wall in the desired preselected association with the outer cabinet wall.

More specifically, the present development comprehends an improved refrigeration apparatus enclosure construction including an outer cabinet, an inner laminate wall within the outer cabinet defined by an inner sheet liner and outer insulation extending between the inner sheet liner and the outer cabinet, the inner liner having folded corner portions to conform the laminate to the contours of the outer cabinet, the insulation being cut through at the folded portions to define voids outwardly of the folded liner portions, insulation means filling the voids, and a rear laminate wall secured to a rear wall of the outer cabinet by insulative support means extending through openings in the insulation to the liner portion of the rear laminate wall.

The development further comprehends a method of constructing such a refrigeration apparatus enclosure including the steps of fabricating an outer cabinet, securing insulative supports to a rear portion of the cabinet, providing a first laminate of sheet liner and insulation, forming openings in the insulation, positioning the first laminate over the insulative supports against the rear wall, slitting a second laminate of sheet liner through the insulation along lines corresponding to the corners of the outer cabinet, folding the sheet liner at the slits with the sheet liner disposed inwardly, fitting the folded laminate within the outer cabinet with the outwardly disposed insulation confronting the inner surfaces of the cabinet, securing the laminate to the outer cabinet, and securing internal components adjacent the liner to the insulative supports.

The present invention comprehends an improved insulative support means including means for preventing rotation of the support means within the insulation as during threading of a screw, or the like, through the inner sheet liner and into the inner end of the insulative support means, such as in attaching a shelf, or the like, to the sheet liner.

In the illustrated embodiment, the rotation preventing means comprises an element having a substantial inner surface facially abutting the outer surface of the insulation to further distribute forces from the insulative support over a substantial area of the insulation. The element may comprise a plate secured to the outer end of the insulative support by a suitable securing element, such as a threaded screw.

The plate may have inwardly projecting means, such as inturned tabs thereon, projecting respectively into the insulative support and the insulation so as to prevent rotation of the insulative support in the through bore of the insulation.

The inturned tabs may define an opening in the central portion of the plate through which the securing means may be extended for securing the plate to the outer end of the insulative support.

The outer cabinet shell may be formed to define a space outwardly of the plate permitting the insulative support and plate to be installed prior to the placement of the laminate wall within the outer cabinet shell.

Thus, the refrigeration apparatus enclosure of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENTS

Figures 1, 2, 3:
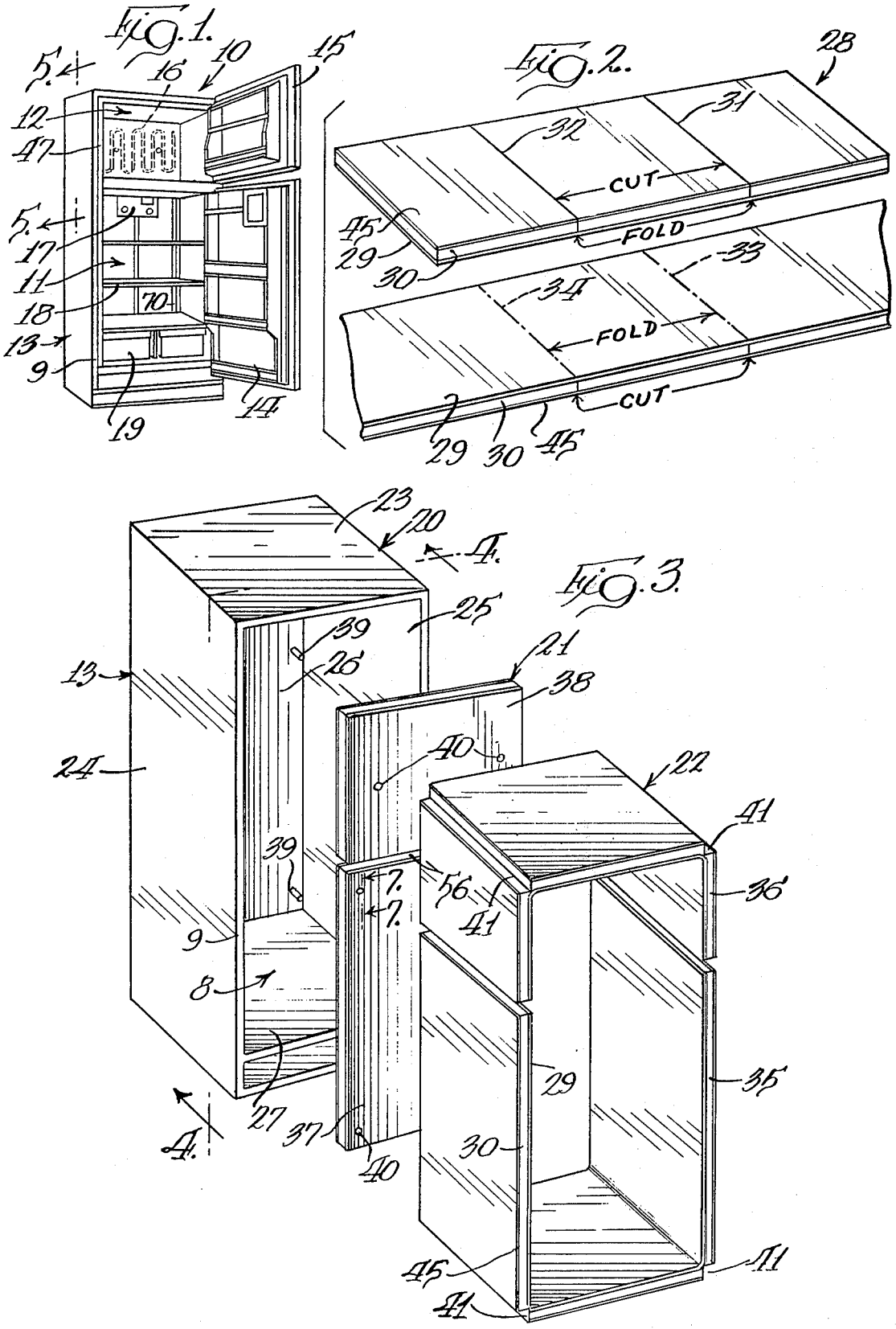
FIG. 1 is a perspective view of a refrigeration apparatus having an enclosure embodying the invention.
FIG. 2 is a fragmentary perspective view of a pair of laminate sheets illustrating the process of forming the same into laminate wall elements of the enclosure construction.
FIG. 3 is an exploded perspective view illustrating the arrangement of the laminate walls in constructing the enclosure of the invention.

In the exemplary embodiment of the invention as shown in FIGS. 1–7 of the drawing, a refrigeration apparatus generally designated 10 illustratively comprises a refrigerator defining an above-freezing compartment 11 and a belowfreezing compartment 12 defined by an insulated enclosure 13 provided with a pair of doors 14 and 15 for selectively closing chambers 11 and 12. The refrigeration apparatus may include conventional evaporator means 16, control means 17, shelves 18, and drawer means 19. The present invention is concerned with the forming of the insulated enclosures 13 and as will be obvious to those skilled in the art, it may be utilized with other arrangements of refrigeration appliances, the refrigerator-freezer arrangement of FIG. 1 being illustrative only.

Broadly, as shown in FIG. 3, the invention comprehends providing an enclosure 13 defined by an outer cabinet generally designated 20, rear wall means generally designated 21, and wall means 22 cooperating with rear wall means 21 to provide an insulative lining of the cabinet. The outer cabinet may be formed in a conventional manner from suitable material, such as metal, to define a forwardly opening boxlike construction having a top wall 23, left sidewall 24, right sidewall 25, rear wall 26, bottom wall 27, and a flange 9 extending around the periphery of the front opening 8. Wall means 21 and 22 cooperatively provide an inner sheet liner means and a body of insulation between the inner sheet liner means and outer cabinet to form the completed enclosure 13.

More specifically, as shown in FIG. 2, the laminate wall means 21 and 22 may be formed from a laminate sheet generally designated 28 defined by a flat sheet liner portion 29 of metal or plastic and a body of insulation 30 bonded between the sheet liner 29 including a thin plastic sheet 45 to form a laminate sandwich which may be provided in continuous length by suitable apparatus (not shown). At spaced intervals, the insulation is cut through, such as at slits 31, 32, 33 and 34, permitting the sheet liner 29 to be folded along the insulation slit lines into a pair of U-shaped laminate wall elements 35 and 36 to define the laminate wall means 22. The flat laminate sheet 28 may be cut into discrete portions 37 and 38 to form the rear wall means 21, as shown in FIG. 3. As shown therein, the first laminate wall element 35 defines an upwardly opening U-shaped configuration and the second laminate wall element 36 defines a downwardly opening U-shaped configuration. The U-shaped configuration and slit insulation allow manipulation of the laminate past the flange 9 when inserting the elements into the cabinet 13 through front opening 8.

As further shown in FIG. 3, cabinet rear wall 26 is provided with a plurality of locating support posts 39 and rear laminate wall portions 37 and 38 are provided with a plurality of corresponding openings 40 for receiving the support posts both for locating the rear wall portions 37 and 38 in centered relationship to the walls 23, 24, 25 and 27 of the outer cabinet and for securing the laminate wall portions 37 and 38 to the rear wall 25 of the cabinet.

Figure 4:
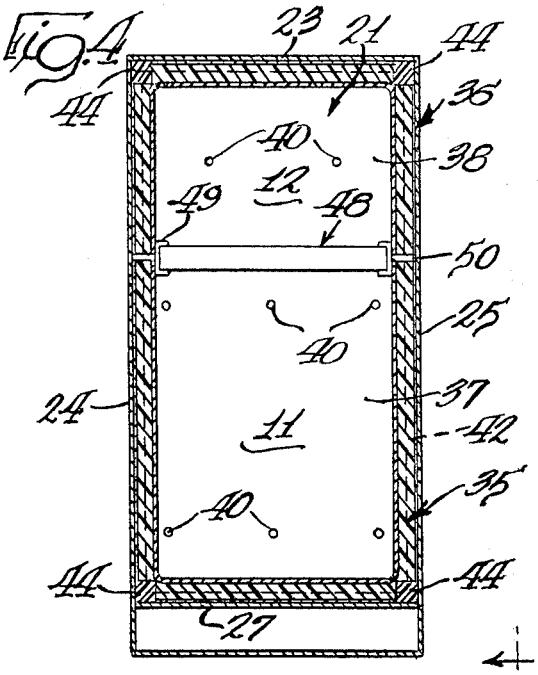
FIG. 4 is a vertical front section of the enclosure taken substantially along the line 4—4 of FIG. 3 after assembly and having a divider wall therein dividing the space within the cabinet into a pair of refrigeration chambers.
Figure 6:
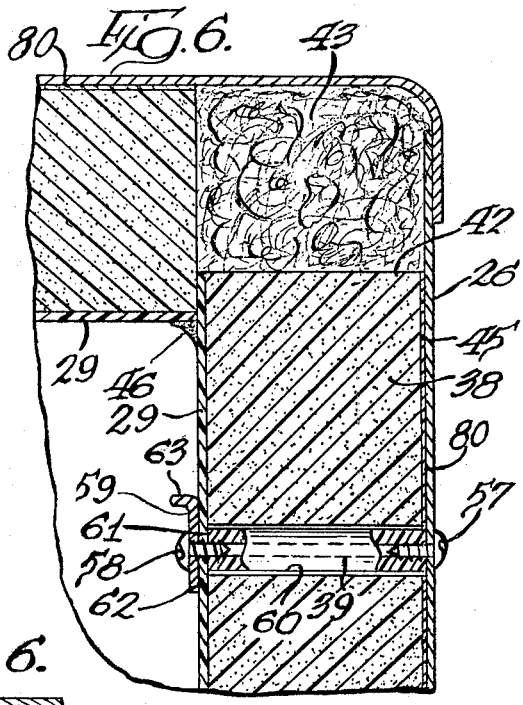
FIG. 6 is a vertical section taken substantially along the line 6—6 of FIG. 5.

As may be seen in FIG. 3, the folded corners of the U-shaped laminate walls 35 and 36 define voids 41. Further, as shown in FIG. 4, as the rear laminate walls 37 and 38 are spaced inwardly from the cabinet walls 23, 24, 25 and 27, respectively, a peripheral void 42 extends fully about the rear laminate wall means 21. In the illustrated embodiment, void 42 is filled with fiberglass insulation 43, as shown in FIG. 6, which may be installed therein prior to the installation of the U-shaped wall elements 35 and 36. By utilizing the separate confronting U-shaped elements 35 and 36, different insulation thicknesses in the insulation means of the refrigeration and freezer compartments of the enclosure 13 may be provided. Further, as seen in FIG. 4, laminate wall elements 35 and 36 may be maintained spaced apart to provide a thermal break in the resultant space 50 between the two compartments.

Figure 5:
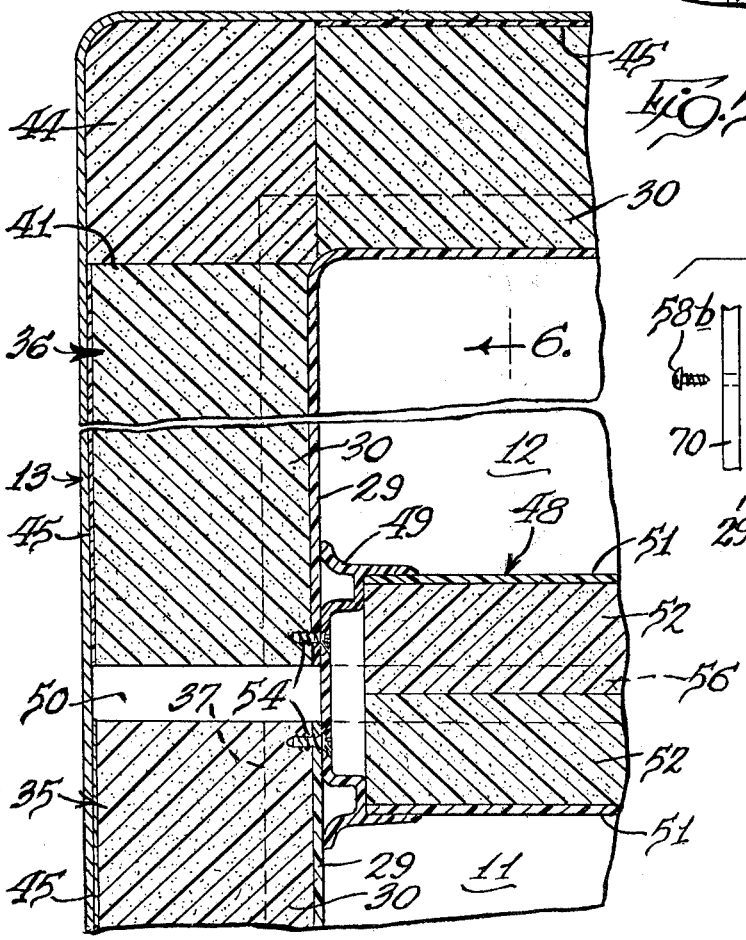
FIG. 5 is a fragmentary enlarged vertical section taken substantially along the line 5—5 of FIG. 1.

As shown in FIG. 5, the voids 41 may be filled with insulation 44. In the illustrated embodiment, insulation 44 comprises foamed-in-place insulation which bonds the laminate walls to the outer cabinet 13 at all four corners of the enclosure. Alternatively, if desired, insulation 44 may comprise preformed blocks of insulation material, such as urethane foam, which may be suitably cemented in place, as desired.

The laminate walls may further be bonded to the cabinet walls by suitable bonding adhesive 80, as desired. In the illustrated embodiment, the sheet 45 provides the insulation means 30 of the laminate walls with an outer vapor barrier.

As illustrated in FIG. 6, a bead of flexible adhesive sealant 46 may be laid along the seams between the sheet liner portion of the U-shaped laminate wall elements 35 and 36 and the front surface of the rear laminate wall portions 37 and 38.

Conventional breaker strip trim 47 may be assembled onto the U-shaped wall elements 35 and 36 and flange 9, as shown in FIG. 1.

As best seen in FIGS. 4 and 5, the compartments 11 and 12 are separated by a divider wall, or mullion, 48 which is retained between the sidewalls of the enclosure by means of a channel bracket 49 secured to sheet liner 29 of upper U-shaped wall element 36 and sheet liner 29 of lower U-shaped wall element 35 adjacent gap 50 so as to straddle the gap and effectively close the same along the sidewalls of the enclosure. Divider wall 48, as best seen in FIG. 5, may comprise a pair of laminate walls including a sheet liner portion 51 and insulation portion 52 which define a double laminate sandwich having top and bottom metal sheet liner wall portions exposed to the chambers 12 and 11, respectively. As shown in FIG. 5, the bracket may be secured to the liners 29 by suitable fasteners, such as screws 54.

As shown in FIG. 6, mounting or support posts 39 for locating and mounting the rear wall portions 37 and 38 comprise plastic posts secured to the outer cabinet, and to the inner sheet liner 29 of the rear laminate walls by suitable means. The fastening means may further serve to mount support brackets to the sheet liner as for carrying the shelves 18 or the evaporator 16 in the enclosure.

More specifically, cabinet rear wall 26 is provided at spaced locations with a plurality of forwardly projecting insulative support posts 39 which, as shown in FIGS. 3 and 6, may be secured to the cabinet wall by suitable securing means, such as screws 57. Illustratively, laminate wall 38 is provided with a corresponding plurality of openings 60 extending through the insulation 30 to the inner sheet liner 29. The front end surface 61 of the support posts is spaced from the cabinet wall 26 a distance substantially equal to the thickness of the insulation 30 so that, as shown in FIG. 6, in the assembled relationship of the elements, the support post surface 61 is flush against the sheet liner 29.

Laminate wall 38 is secured to the support posts 39 by the clip bracket 59 and suitable fastening means, such as screw 58, extending through one leg 62 of the bracket through openings 40 in the sheet liner 29 and into the inner end of the support post. Clip bracket 59 further defines a turned end 63 projecting inwardly from the sheet liner to define a support portion such as for supporting the heat exchanger 16 or brackets 70 provided for carrying the shelves 15 within the enclosure on laminate wall 37.

Figure 7:
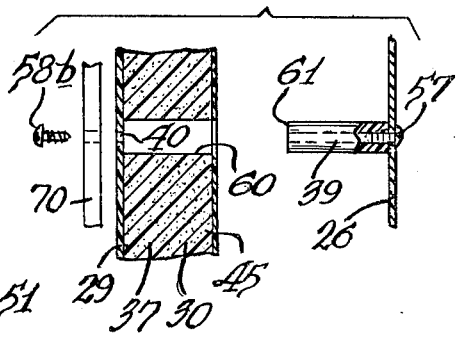
FIG. 7 is a vertical section taken substantially along the line 7—7 of FIG. 3.

As shown in FIG. 7, the support posts 39 are secured to the rear cabinet wall 26 by screws 57. In the illustration shown, the rear laminate wall portion 37 is then fitted over the posts and secured thereto by screws 58b which also pass through bracket 70 to also secure the bracket to the posts 39. As shown, the opening 60 may be slightly larger than the cross section of the support post for facilitated installation of the laminate wall on the cabinet wall.

The support posts 39 may be formed of a suitable insulative material, such as molded synthetic resin, and thus, effectively maintain the thermal insulation between the sheet liner 29 and the outer cabinet 26. By suitably positioning the support posts 39 and the openings 60, the peripheral edge of the sheet liner 19 may be maintained spaced inwardly from the side walls 24 and 25, top wall 23 and bottom wall 27 of the outer cabinet so as to maintain the insulated association of the sheet liner to the outer cabinet. In illustrating the invention, the laminate walls 37 and 38 are described as the back walls of the enclosure. As will be obvious to those skilled in the art, any portion of the cabinet may be so constructed as to utilize the support within the scope of the invention.

Thus, the invention comprehends an improved simplified method of constructing a refrigeration apparatus enclosure wherein a plurality of flat laminates defining an inner sheet liner and an outer insulation are provided. The laminates for the back wall are inserted first into the outer cabinet and maintained in position by the insulative support posts. The other laminates are folded to conform to the internal configuration of the cabinet after firstly slitting the insulation along the desired fold lines with the laminate elements being firstly cut from a continuous low cost laminate stock material. Internal elements, such as the heat exchanger and shelf supports, can be mounted to the rear wall laminates by securing them to the insulative supports.

The use of the laminate construction permits adaptation of the internal construction of the enclosure to a wide variety of sizes and shapes of the refrigeration appliance enclosure. As the insulative supports effectively position the rear wall laminates in spaced relationship to the cabinet sides, the internal construction is easily assembled without fixtures. Mounting of the evaporator and shelf brackets to the insulative supports provides a support which will not crack the inner liner when plastic is utilized for the inner liner material.

Figure 8:
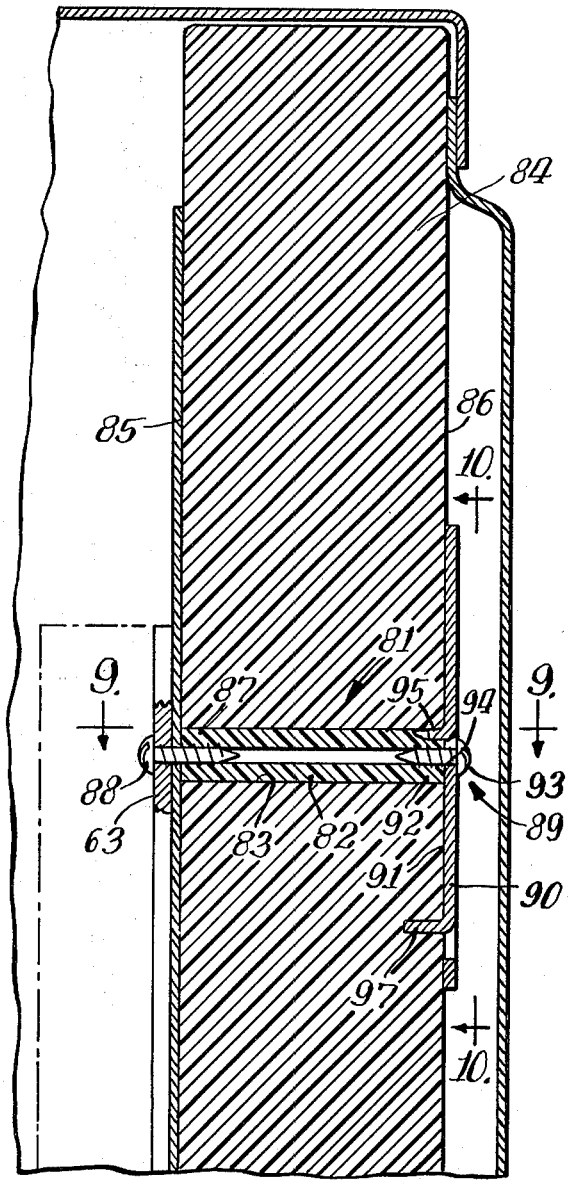
FIG. 8 is a fragmentary section generally similar to that of FIG. 6 but showing a modified form of insulative support means embodying the invention.
Figure 10:
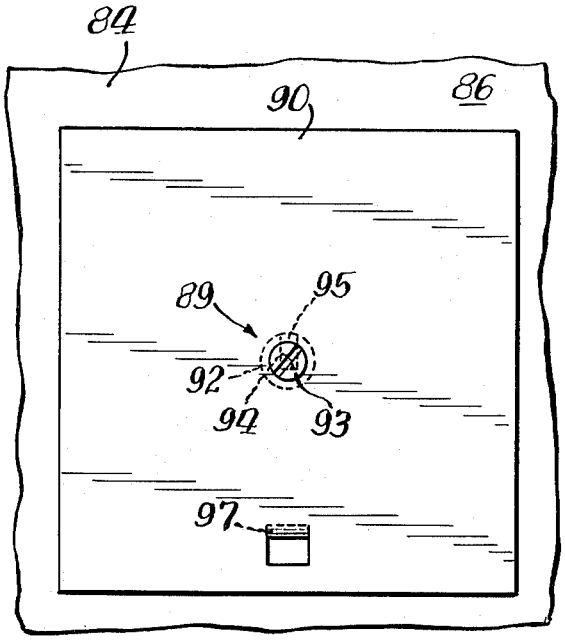
FIG. 10 is a vertical section taken substantially along the line 10—10 of FIG. 8.
Figure 9:
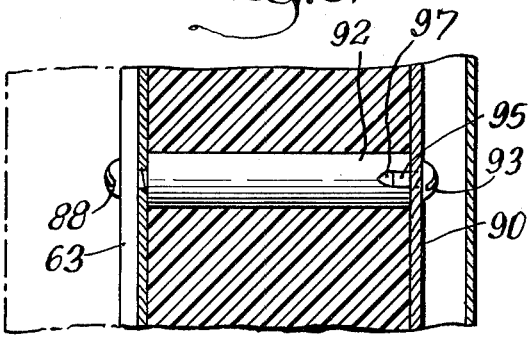
FIG. 9 is a horizontal section taken substantially along the line 9—9 of FIG. 8.

Referring now to the embodiments of FIGS. 8–10, a modified form of insulative support means generally designated 81 is shown to include a tubular insulative support post 82 received in a through bore 83 in the outer insulation 84 and extending substantially fully between an inner surface 85 and an outer surface 86 of the insulation.

As discussed relative to support post 39, the post may be utilized to support elements within the refrigeration apparatus cabinet, such as by bracket 63. As shown in FIG. 8, the bracket may be secured to the inner end 87 of the support post by a screw 88 extending through the sheet liner 85 and into the inner end 87 of the post.

The invention comprehends providing means for retaining the post against rotation during the threading of the screw 88 thereinto. The retaining means generally designated 89 includes a flat plate 90 having an inner surface 91 facially abutting the insulation surface 86 about bore 83. The plate may be secured to the outer end 92 of the support post by suitable means, such as screw 93. The plate may be provided with a suitable opening 94 for passing the shank of screw 93 therethrough, and in the illustrated embodiment, opening 94 is defined by the portion of the plate inturned to define a tab 95 extending into the outer end 92 of support post 82.

A second tab 96 is struck from plate 90 at a distance outwardly of the opening 94 to extend into the insulation 84 and lock the plate against rotation about the axis of opening 94.

As the support post is secured to the nonrotatably mounted plate, the support post is also nonrotatively retained in the through bore 83, permitting the facilitated installation of the support brackets 63 in the cabinet by means of screws 88.

As seen in FIG. 9, the support post end 92 may be provided with a recess 97 for receiving the tab 95 for facilitated installation of the plate 90 in the retaining means 89.

Figure 11:
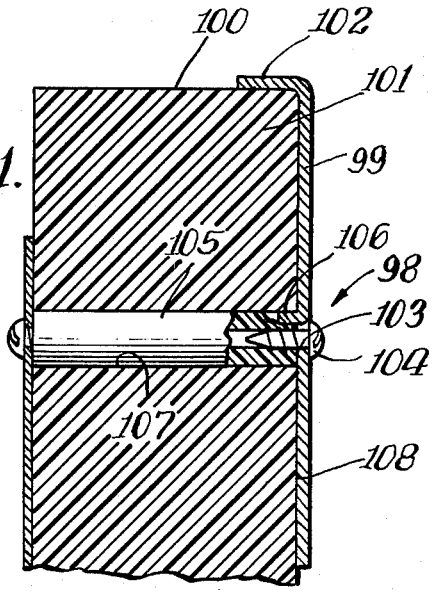
FIG. 11 is a vertical section illustrating another modified form of insulative support means embodying the invention.

Turning now to the embodiment of FIG. 11, a further modified form of the invention is shown to comprise a retaining means 98 generally similar to retaining means 89 but having a retaining plate 99 extending to an edge 100 of insulation 101 and provided with an inturned end flange 102 overlying the edge 100 for preventing rotation of the plate about the axis of opening 103 therein. A screw 104 extends through opening 103 to lock the plate to the insulative support 105 and an inturned tab 106 is provided on the plate for locking the support post 105 against rotation in through bore 107.

Thus, except for the different arrangement of the means for preventing rotation of the plate relative to the outer surface 108 of insulation 101, retaining means 98 is similar to retaining means 89 and functions in a similar manner in providing an improved insulative support means in the cabinet construction.

In the illustrated embodiments, the plate is provided with integral rotation preventing means. As will be obvious to those skilled in the art, any suitable inwardly extending projection means may be utilized within the scope of the invention. Similarly, while a screw 93 is illustrated as defining the means for locking the plate to the outer portion of the support post, a suitable securing means may be utilized within the scope of the invention.

Further, while the openings 93 and 103 are illustrated as at the center of the retaining plate, as will be obvious to those skilled in the art, they may be disposed suitably as desired within the scope of the invention.

The foregoing disclosure of specific embodiments is illustrative of the broad inventive concepts comprehended by the invention.

I claim:

1. A refrigeration apparatus wall structure comprising: a laminate wall defined by an inner sheet liner and an outer insulation defining an outer surface, said insulation having a through right circularly cylindrical bore extending inwardly therethrough to said sheet liner; a right circularly cylindrical insulative support complementarily received in said bore and having an inner end abutting said sheet liner; a threaded connector extended through said liner into threaded engagement with said inner end of the support; and retaining means fixedly facially engaging said outer surface of the insulation and interlocked with said support for preventing rotation of said support by the threading of said threaded connector element into said inner end.

2. The refrigeration apparatus wall structure of claim 1 wherein said retaining means comprises a flat plate.

3. The refrigeration apparatus wall structure of claim 1 wherein said retaining means includes a projection extending inwardly into an outer end portion of said support.

4. The refrigeration apparatus wall structure of claim 1 wherein said support defines an outer end at said insulation outer surface, and said retaining means further includes a locking means for locking said plate against longitudinal outward displacement from said support outer end.

5. The refrigeration apparatus wall structure of claim 1 wherein said support comprises a tubular element.

6. The refrigeration apparatus wall structure of claim 1 wherein said retaining means includes an inwardly projecting locking means spaced from said insulation bore and extending into said outer surface of said insulation for preventing rotation of said retaining means against said outer surface.

7. The refrigeration apparatus wall structure of claim 1 wherein the retaining means includes a turned edge engaging an edge portion of the insulation for preventing rotation thereof relative to the insulation.

8. A refrigeration apparatus wall structure comprising: a laminate wall defined by an inner sheet liner and an outer insulation defining an outer surface, said insulation having a through right circularly cylindrical bore extending inwardly therethrough to said sheet liner; a right circularly cylindrical insulative support complementarily received in said bore and having an inner end abutting said sheet liner; a threaded connector extended through said liner into threaded engagement with said inner end of the support; and retaining means fixedly facially engaging said outer surface of the insulation and interlocked with said support for preventing rotation of said support by the threading of said threaded connector element into said inner end, said retaining means having an area substantially greater than the cross-sectional area of said support for distributing forces from said support over a substantial area of said insulation outer surface.

9. The refrigeration apparatus wall structure of claim 8 wherein said retaining means comprises a flat plate.

10. The refrigeration apparatus wall structure of claim 8 wherein said retaining means comprises a flat plate and inwardly extending means securing the center of the flat plate to said support.

11. The refrigeration apparatus wall structure of claim 8 wherein said retaining means comprises a plate having an inturned tab engaging the support and an opening adjacent the tab, a screw being extended through said opening to lock said plate against movement outwardly away from said support.

* * * * *